US011187065B2

(12) United States Patent
Lu et al.

(10) Patent No.: US 11,187,065 B2
(45) Date of Patent: Nov. 30, 2021

(54) COMPOSITE NITROGEN HUFF AND PUFF METHOD FOR BOUNDED FAULT BLOCK RESERVOIR

(71) Applicant: CHINA UNIVERSITY OF PETROLEUM, Qingdao (CN)

(72) Inventors: Teng Lu, Qingdao (CN); Zhaomin Li, Qingdao (CN); Jian Li, Qingdao (CN); Dingyong Zhang, Qingdao (CN); Dawei Hou, Qingdao (CN); Binfei Li, Qingdao (CN)

(73) Assignee: CHINA UNIVERSITY OF PETROLEUM, Qingdao (CN)

( * ) Notice: Subject to any disclaimer, the term of this patent is extended or adjusted under 35 U.S.C. 154(b) by 374 days.

(21) Appl. No.: 16/472,827

(22) PCT Filed: Jan. 15, 2019

(86) PCT No.: PCT/CN2019/071824
§ 371 (c)(1),
(2) Date: Jun. 21, 2019

(87) PCT Pub. No.: WO2019/223346
PCT Pub. Date: Nov. 28, 2019

(65) Prior Publication Data

US 2021/0332680 A1 Oct. 28, 2021

(30) Foreign Application Priority Data

May 25, 2018 (CN) ..... 201810514761.7

(51) Int. Cl.
*E21B 43/16* (2006.01)

(52) U.S. Cl.
CPC ..... *E21B 43/168* (2013.01)

(58) Field of Classification Search
CPC ..... E21B 43/162; E21B 43/164; E21B 43/16; E21B 43/166; E21B 43/168
See application file for complete search history.

(56) References Cited

U.S. PATENT DOCUMENTS

2019/0055825 A1* 2/2019 Babcock ..... C09K 8/594

* cited by examiner

*Primary Examiner* — Taras P Bemko
*Assistant Examiner* — Yanick A Akaragwe
(74) *Attorney, Agent, or Firm* — CBM Patent Consulting, LLC

(57) ABSTRACT

A composite nitrogen huff and puff method for a bounded fault block reservoir comprises: selecting the reservoir to be developed, wherein the reservoir to which the development method is applicable is roughly screened according to the following conditions: the reservoir is a bounded fault block reservoir, buried depth<5000 m, residual oil saturation>0.5, reservoir thickness>10 m, horizontal permeability>100 mD, vertical permeability to horizontal permeability ratio>0.35, reservoir porosity>0.20, and stratigraphic dip>8°; and sequentially performing the following huff and puff phases: a nitrogen huff and puff phase, a nitrogen and water composite huff and puff phase, a nitrogen and foaming agent composite huff and puff phase, and a nitrogen and carbon dioxide composite huff and puff phase.

5 Claims, 2 Drawing Sheets

COMPOSITE NITROGEN HUFF AND PUFF METHOD FOR BOUNDED FAULT BLOCK RESERVOIR

BACKGROUND OF THE INVENTION

1. Technical Field

The invention relates to a composite nitrogen huff and puff method for a bounded fault block reservoir, and belongs to the technical field of oil-gas field development.

2. Description of Related Art

Bounded fault block reservoirs refer to the accumulation of oil and gas in a trap formed by the shielding effect of multiple faults. Due to the low oil-bearing area and reserves of the bounded fault block reservoirs, a "one injection, one production" well pattern cannot be established independently for a reservoir stratum. Most bounded small fault block reservoirs have only one production well. Therefore, it is difficult to perfect a well pattern, the degree of water flooding control is low, energy degradation is fast, and the development of bounded small fault block reservoirs shows the characteristics of low liquid yield and low recovery percent. In view of these problems, it is necessary to carry out research on effective development of bounded fault block reservoirs to improve the recovery ratio of bounded fault block reservoirs with imperfect injection and production.

At present, nitrogen flooding, foam flooding and carbon dioxide flooding have been applied in conventional oil reservoirs and have achieved good development results. However, the application of these oil reservoirs is realized by injection-production well patterns, that is, nitrogen, foaming agents, water, carbon dioxide, etc. are injected into an injection well, and crude oil in the stratum is displaced under the action of displacement pressure difference after injection to produce crude oil in a production well. However, due to the low oil-bearing area and reserves of the bounded small fault block reservoirs, a "one injection, one production" well pattern cannot be established independently for a reservoir stratum. Most bounded small fault block reservoirs have only one production well, so the above nitrogen flooding, foam flooding and carbon dioxide flooding cannot be implemented in the bounded small fault block reservoirs.

In consideration of the characteristics of the bounded fault block reservoirs, some scholars have proposed nitrogen huff and puff and other development methods. Injecting nitrogen into a well in the bounded fault block reservoir can effectively supplement stratum energy. Nitrogen huff and puff does not need a perfect well pattern, and can be realized by a single well, thus solving the difficulties in water injection and in establishing an effective pressure system. At present, relevant research on the nitrogen huff and puff technology has been carried out in terms of optimization of injection and production parameters and equipment matching. However, after 2-3 cycles of nitrogen huff and puff during field implementation in the bounded small fault block reservoir, it was found that the periodic recovery degree was lower and lower, the oil exchange rate was low, and the huff and puff effect was not ideal. The main problems are as follows: (1) with the increase of huff and puff cycles, large continuous channels tend to be formed in the stratum for nitrogen, gas channeling is serious in the mining process, and effective residence of nitrogen in the stratum cannot be achieved; (2) the solubility of nitrogen is low and it is difficult to greatly improve the expansibility of crude oil; and (3) nitrogen and crude oil are immiscible under normal reservoir conditions, which makes it difficult to reduce the viscosity of crude oil. Therefore, the invention discloses a composite nitrogen huff and puff method, which enhances the technical effect of nitrogen huff and puff in the bounded small fault block reservoir.

BRIEF SUMMARY OF THE INVENTION

In view of the defects of the prior art, the invention provides a composite nitrogen huff and puff method for a bounded fault block reservoir. The invention adjusts a development method with an unsatisfactory nitrogen huff and puff effect at the later stage by improving the nitrogen huff and puff effect at the later stage. Adding water, foaming agent solution, carbon dioxide and other slugs during nitrogen huff and puff can effectively enhance the effect of nitrogen huff and puff to increase production, and realize efficient and stable development of the bounded fault block reservoir at the later stage of nitrogen huff and puff.

The technical scheme of the invention is as follows:

A composite nitrogen huff and puff method for a bounded fault block reservoir, comprising:

selecting the reservoir to be developed, wherein the reservoir to which the development method is applicable is roughly screened according to the following conditions: the reservoir is a bounded fault block reservoir, buried depth <5000 m, residual oil saturation >0.5, reservoir thickness>10 m, horizontal permeability>100 mD, vertical permeability to horizontal permeability ratio>0.35, reservoir porosity>0.20, and stratigraphic dip>8°; and sequentially performing the following huff and puff phases: a nitrogen huff and puff phase, a nitrogen and water composite huff and puff phase, a nitrogen and foaming agent composite huff and puff phase, and a nitrogen and carbon dioxide composite huff and puff phase.

In another aspect disclosed by the invention, the nitrogen huff and puff phase comprises the following steps: drilling a horizontal well or a vertical well in the bounded fault block reservoir; injecting nitrogen into the well, wherein the nitrogen injection amount is 50000-300000 $m^3$, and the larger the reservoir area is, the larger the nitrogen injection amount is; after nitrogen is injected, closing the well for soaking, wherein the pressure change of the well is observed during soaking, the pressure drops fast in the initial stage of soaking, as soaking progresses, nitrogen gradually expands to the top of the stratum, the rate of pressure drop gradually decreases, when the rate of pressure drop reaches an inflection point, nitrogen diffuses to the top of an oil bed, and then the soaking process which lasts for 10-30 days is ended; and after soaking, opening the well for production, wherein crude oil and nitrogen are continuously produced in the production process, the oil production speed is high and the gas production speed is low at the initial stage of production, the oil production speed gradually decreases as production progresses, and production is finished when the oil production speed is lower than 0.1-0.5 tons/day.

The nitrogen huff and puff phase is repeated till: when the oil production (ton) and nitrogen injection ($10^4$ $m^3$) in a certain cycle are less than 5, that is, when the oil production by injecting $10^4$ $m^3$ nitrogen in this cycle is less than 5 tons, the nitrogen huff and puff effect and economic benefit in this cycle are poor, and the nitrogen and water composite huff and puff phase is adopted in the next cycle. As the number of nitrogen huff and puff cycles increases, the effect of nitrogen huff and puff gradually becomes poor. This is because channels for gas channeling are formed for nitrogen after multiples cycles of nitrogen huff and puff, and injected nitrogen is produced quickly and cannot be effectively sealed in the stratum for displacement.

In another aspect disclosed by the invention, the nitrogen and water composite huff and puff phase comprises an injection phase, a soaking phase and a stoping phase.

The injection method in the injection phase is as follows:

for medium and high permeability reservoirs with permeability greater than or equal to 100 mD, nitrogen is injected first with an injection amount of 50000-300000 $m^3$, and the larger the reservoir area, the larger the nitrogen injection amount; and then water is injected with an injection volume of 100-500 $m^3$, and the larger the reservoir area, the larger the water injection volume; and for low permeability reservoirs with permeability less than 100 mD, due to the low permeability of the low permeability reservoirs, nitrogen cannot be injected continuously due to the limitation of the injection pressure of surface nitrogen injection equipment; a nitrogen slug and a water slug are injected alternately, and the nitrogen slug is injected first with the injection amount depending on the pressure limitation of the nitrogen injection equipment; when the nitrogen injection pressure reaches the upper limit of the injection pressure of the nitrogen injection equipment, nitrogen injection is stopped and water slug injection is started; the purpose of injecting the water slug is to press nitrogen into the stratum and reduce the nitrogen injection pressure, and the injection volume of the water slug is 30-50 $m^3$; after injecting the water slug, the nitrogen slug is injected again till the nitrogen injection pressure reaches the upper limit of the injection pressure of the nitrogen injection equipment, and then the water slug is injected again; and the nitrogen slug and the water slug are injected alternately till the total nitrogen injection reaches 50000-300000 $m^3$, and the larger the reservoir area, the larger the nitrogen injection.

After injection, soaking production starts. As the injection of the water slug can push nitrogen to the top of the oil bed quickly, soaking time is short, which is 5-10 days.

After soaking, stoping starts. After water injection, big pore channels for nitrogen communication can be blocked, so that continuous channels for gas channeling cannot be formed for nitrogen, and nitrogen sealed in the stratum can better increase the stratum energy; with the decrease of wellhead energy, the blocked nitrogen will drive the reservoir volume unswept and replace crude oil till, when the oil production (ton) and nitrogen injection ($10^4$ $m^3$) in a certain cycle are less than 5, that is, when the oil production by injecting $10^4$ $m^3$ nitrogen in this cycle is less than 5 tons, the nitrogen and foaming agent composite huff and puff phase is adopted in the next cycle. With the increase of the number of nitrogen and water composite huff and puff cycles, the effect becomes poor gradually, which is due to the limited ability of the water slug to block nitrogen gas channeling and the limited effect of infiltration displacement of water, leading to reduced oil production after multiple cycles of huff and puff. In addition, water can exert its infiltration displacement capability through capillary force during soaking, so nitrogen and water composite huff and puff can improve the nitrogen huff and puff effect.

In another aspect disclosed by the invention, the nitrogen and foaming agent composite huff and puff phase comprises an injection phase, a soaking phase and a stoping phase.

For medium and high permeability reservoirs with permeability greater than or equal to 100 mD, nitrogen is injected first with an injection amount of 50000-300000 $m^3$, and the larger the reservoir area, the larger the nitrogen injection amount; and then a foaming agent solution is injected with an injection volume of 100-500 $m^3$, the foaming agent is anion surfactant, the concentration of the foaming agent is 0.3-0.5 wt %, and the larger the reservoir area, the larger the foaming agent solution injection volume; and for low permeability reservoirs with permeability less than 100 mD, due to the low permeability of the low permeability reservoirs, nitrogen cannot be injected continuously due to the limitation of the injection pressure of surface nitrogen injection equipment; therefore, the second injection method is to alternately inject a nitrogen slug and a foaming agent solution slug, and the nitrogen slug is injected first with the injection amount depending on the pressure limitation of the nitrogen injection equipment; when the nitrogen injection pressure reaches the upper limit of the injection pressure of the nitrogen injection equipment, nitrogen injection is stopped and foaming agent solution slug injection is started; the purpose of injecting the foaming agent solution slug is to press nitrogen into the stratum and reduce the nitrogen injection pressure, and the injection volume of the foaming agent solution slug is 30-50 $m^3$; after injecting the foaming agent solution slug, the nitrogen slug is injected again till the nitrogen injection pressure reaches the upper limit of the injection pressure of the nitrogen injection equipment, and then the foaming agent solution slug is injected again; and the nitrogen slug and the foaming agent solution slug are injected alternately till the total nitrogen injection reaches 50000-300000 $m^3$, and the larger the reservoir area, the larger the nitrogen injection.

After injection, soaking production starts. As the injection of the foaming agent solution slug can push nitrogen to the top of the oil bed quickly, soaking time is 5-10 days.

After soaking, stoping starts till, when the oil production (ton) and nitrogen injection ($10^4$ $m^3$) in a certain cycle are less than 5, that is, when the oil production by injecting $10^4$ $m^3$ nitrogen in this cycle is less than 5 tons, the nitrogen and carbon dioxide composite huff and puff phase is adopted in the next cycle. With the increase of the number of nitrogen and foaming agent composite huff and puff cycles, the effect becomes poor gradually. This is because the several huff and puff methods mentioned above have limited sweep range in the stratum, and nitrogen, water and foaming agent solution cannot effectively act on the deep stratum. After the foaming agent solution is injected, a foam state of nitrogen can be formed by the foaming agent solution and the stoped nitrogen, and the nitrogen foam has a strong ability of blocking gas channeling, so as to better block the big pore channels for nitrogen communication, as a result, continuous channels for gas channeling cannot be formed for nitrogen, and nitrogen sealed in the stratum can better increase the stratum energy. Besides, the foaming agent solution can improve the displacement efficiency and the development effect.

In another aspect disclosed by the invention, the nitrogen and carbon dioxide composite huff and puff phase comprises an injection phase, a soaking phase and a stoping phase.

Carbon dioxide is injected first with an injection amount of 10-50 tons, and the larger the reservoir area, the larger the carbon dioxide injection; and then nitrogen is injected with an injection volume of 50000-300000 $m^3$, and the larger the reservoir area, the larger the nitrogen injection.

After injection, soaking starts. In order to improve the diffusion range of carbon dioxide and the contact time with crude oil, soaking time needs to be prolonged, and the soaking time is set to be 30-90 days.

Stoping starts after soaking. Carbon dioxide can well reduce the viscosity of crude oil and increase the expansion performance of crude oil. Carbon dioxide and crude oil are miscible to increase the fluidity of remaining oil and improve the nitrogen huff and puff effect.

The invention has the advantages that:

The technical problem to be solved by the invention is: due to the low oil-bearing area and reserves of the bounded fault block reservoirs, a "one injection, one production" well pattern cannot be established independently for a reservoir stratum. Most bounded small fault block reservoirs have only one production well. Therefore, it is difficult to perfect a well pattern, the degree of water flooding control is low, energy degradation is fast, and the development of bounded small fault block reservoirs shows the characteristics of low liquid yield and low recovery percent.

The invention provides a composite nitrogen huff and puff method for a bounded fault block reservoir. According to the method, a well in the bounded reservoir is utilized, and nitrogen huff and puff, nitrogen and water composite huff and puff, nitrogen and foaming agent composite huff and puff, and nitrogen and carbon dioxide composite huff and puff are implemented at different stages. The method can effectively solve the problems of low water flooding control degree and fast energy degradation in the bounded fault block reservoir, and the composite nitrogen huff and puff can solve the problem of poor effect in the later stage of single nitrogen huff and puff, thus, the development effect of the bounded fault block reservoir is improved, and the energy extraction efficiency is greatly improved.

DETAILED DESCRIPTION OF THE INVENTION

Figure 1:
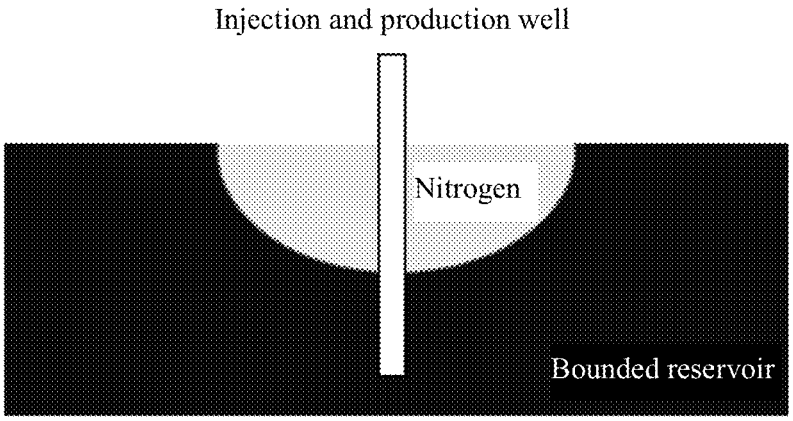
FIG. 1 is a schematic diagram of injection during nitrogen huff and puff.
Figure 2:
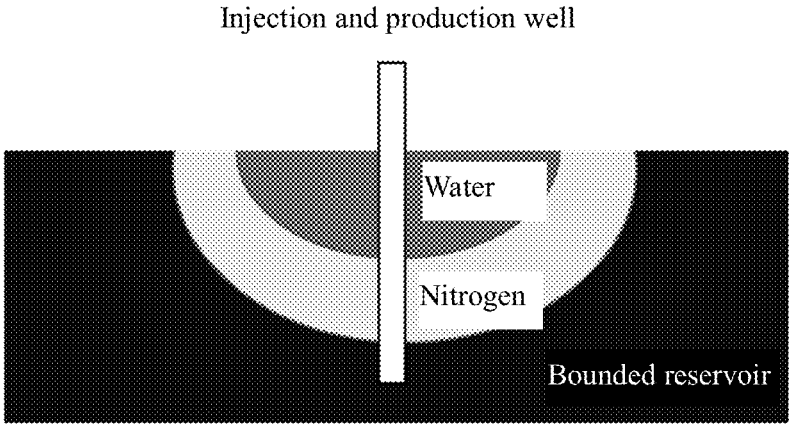
FIG. 2 is a schematic diagram of nitrogen and water composite huff and puff.
Figure 3:
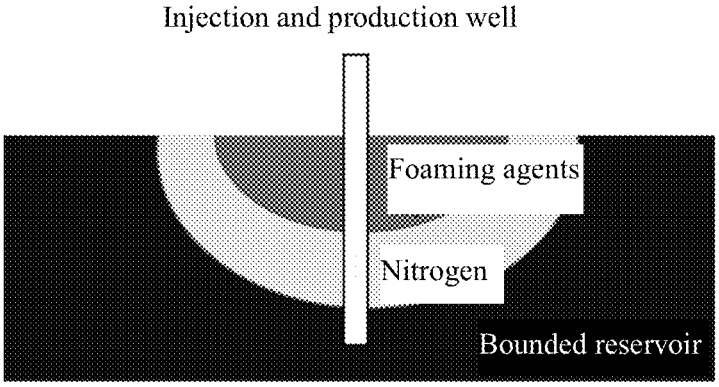
FIG. 3 is a schematic diagram of nitrogen and foaming agent composite huff and puff.
Figure 4:
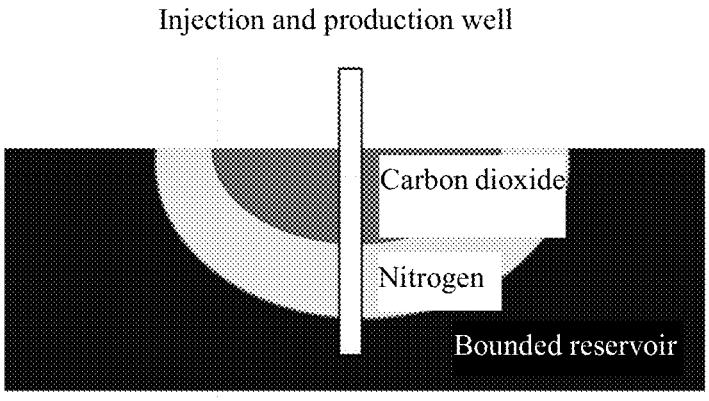
FIG. 4 is a schematic diagram of nitrogen and carbon dioxide composite huff and puff.

The present invention will be described in detail below with reference to specific embodiments and drawings of the specification, but is not limited thereto.

Embodiment

A composite nitrogen huff and puff method for a bounded fault block reservoir, comprising:

selecting the reservoir to be developed, wherein the reservoir to which the development method is applicable is roughly screened according to the following conditions: the reservoir is a bounded fault block reservoir, buried depth<5000 m, residual oil saturation>0.5, reservoir thickness>10 m, horizontal permeability>100 mD, vertical permeability to horizontal permeability ratio>0.35, reservoir porosity>0.20, and stratigraphic dip>8°;

taking this embodiment as an example, the reservoir selected for development is a bounded reservoir, the reservoir is mainly composed of packsand and siltstone, the reservoir is bounded with a stratigraphic dip of 15°, and water injection cannot be used for energy supplement; the stratum pressure is 22 MPa, the temperature is 94° C., the average porosity is 20.8%, and the average air permeability is $46\times10^{-3}$ μm2; the type of the reservoir is a lithologic structural reservoir with normal pressure and low permeability, which is favorable for nitrogen injection; and sequentially performing the following huff and puff phases: a nitrogen huff and puff phase, a nitrogen and water composite huff and puff phase, a nitrogen and foaming agent composite huff and puff phase, and a nitrogen and carbon dioxide composite huff and puff phase.

Phase 1: the nitrogen huff and puff phase comprises the following steps: drilling a horizontal well or a vertical well in the bounded fault block reservoir; injecting nitrogen into the well, wherein the nitrogen injection amount is 50000-300000 $m^3$, and soaking time is 10-30 days; and after soaking, opening the well for production, wherein production is finished when the oil production speed is lower than 0.1-0.5 tons/day.

Phase 2: the nitrogen huff and puff phase is repeated till: when the oil production (ton) and nitrogen injection ($10^4$ $m^3$) in a certain cycle are less than 5, that is, when the oil production by injecting $10^4$ $m^3$ nitrogen in this cycle is less than 5 tons, the nitrogen and water composite huff and puff phase is adopted in the next cycle.

Phase 3: the nitrogen and water composite huff and puff phase comprises an injection phase, a soaking phase and a stoping phase.

The injection method in the injection phase is as follows:

for medium and high permeability reservoirs with permeability greater than or equal to 100 mD, nitrogen is injected first with an injection amount of 50000-300000 $m^3$; and then water is injected with an injection volume of 100-500 $m^3$; and for low permeability reservoirs with permeability less than 100 mD, a nitrogen slug and a water slug are injected alternately, and the nitrogen slug is injected first with the injection amount depending on the pressure limitation of the nitrogen injection equipment; when the nitrogen injection pressure reaches the upper limit of the injection pressure of the nitrogen injection equipment, nitrogen injection is stopped and water slug injection is started, and the injection volume of the water slug is 30-50 $m^3$; after injecting the water slug, the nitrogen slug is injected again till the nitrogen injection pressure reaches the upper limit of the injection pressure of the nitrogen injection equipment, and then the water slug is injected again; and the nitrogen slug and the water slug are injected alternately till the total nitrogen injection reaches 50000-300000 $m^3$.

After injection, soaking production starts and lasts for 5-10 days.

After soaking, stoping starts, and crude oil is replaced till: when the oil production (ton) and nitrogen injection ($10^4$ $m^3$) in a certain cycle are less than 5, that is, when the oil production by injecting $10^4$ $m^3$ nitrogen in this cycle is less than 5 tons, the nitrogen and foaming agent composite huff and puff phase is adopted in the next cycle.

In this embodiment, in the third phase of composite nitrogen huff and puff, the injection volume of nitrogen is 200000 $m^3$ and the injection volume of the water slug is 60 $m^3$. After the water slug is injected, a pressure gauge is installed at a wellhead to start soaking. In order to ensure full infiltration of the water slug, the soaking time is 10 days. After that, blowout is controlled by a nozzle to prevent the stratum from being disturbed and the water slug from being damaged due to the excessive blowout speed. After blowout, pumping conversion is conducted, and when the set limit output is reached, the next cycle of composite nitrogen huff and puff is conducted.

Phase 4: the nitrogen and foaming agent composite huff and puff phase comprises an injection phase, a soaking phase and a stoping phase.

For medium and high permeability reservoirs with permeability greater than or equal to 100 mD, nitrogen is injected first with an injection amount of 50000-300000 $m^3$; and then a foaming agent solution is injected with an injection volume of 100-500 $m^3$, the foaming agent is anion surfactant, and the concentration of the foaming agent is 0.3-0.5 wt %; and for low permeability reservoirs with permeability less than 100 mD, a nitrogen slug and a foaming agent solution slug are alternately injected, and the nitrogen slug is injected first with the injection amount depending on the pressure limitation of the nitrogen injection equipment; when the nitrogen injection pressure reaches the upper limit of the injection pressure of the nitrogen injection equipment, nitrogen injection is stopped and foaming agent solution slug injection is started, and the injection volume of the foaming agent solution slug is 30-50 $m^3$; after injecting the foaming agent solution slug, the nitrogen slug is injected again till the nitrogen injection pressure reaches the upper limit of the injection pressure of the nitrogen injection equipment, and then the foaming agent solution slug is injected again; and the nitrogen slug and the foaming agent solution slug are injected alternately till the total nitrogen injection reaches 50000-300000 $m^3$.

After injection, soaking production starts and lasts for 5-10 days.

After soaking, stoping starts till: when the oil production (ton) and nitrogen injection ($10^4$ $m^3$) in a certain cycle are less than 5, that is, when the oil production by injecting $10^4$ $m^3$ nitrogen in this cycle is less than 5 tons, the nitrogen and carbon dioxide composite huff and puff phase is adopted in the next cycle.

In this embodiment, in the fourth phase of injection of composite nitrogen huff and puff, the injection volume of nitrogen is 230000 $m^3$ and the injection volume of the 0.5% foaming agent solution is 40 $m^3$. After the foaming agent solution is injected, a wellhead pressure gauge is installed to start soaking for 5 days, and then a nozzle is used to control blowout, allowing nitrogen to slowly and evenly pass through the big pore channels to form a continuous foam slug. After blowout, pumping conversion is conducted, and when the set limit output is reached, the next cycle of composite nitrogen huff and puff is conducted.

Due to the high yield, nitrogen+foaming agent solution huff and puff is continued.

Phase 5: in the injection phase of composite nitrogen huff and puff, the injection volume of nitrogen is 250000 $m^3$, and the injection volume of 0.5% HY-2 (the foaming agent solution) is 60 $m^3$. After the foaming agent solution is injected, a wellhead pressure gauge is installed to start soaking for 5 days, and then a nozzle is used to control blowout, allowing nitrogen to slowly and evenly pass through the big pore channels to form a continuous foam slug. After blowout, pumping conversion is conducted, and when the set limit output is reached, the next cycle of composite nitrogen huff and puff is conducted.

Phase 6: the nitrogen and carbon dioxide composite huff and puff phase comprises an injection phase, a soaking phase and a stoping phase.

Carbon dioxide is injected first with an injection amount of 10-50 tons, and then nitrogen is injected with an injection volume of 50000-300000 $m^3$.

After injection, soaking starts and lasts for 30-90 days.

After soaking, stoping starts.

In this embodiment, in the sixth phase of injection of composite nitrogen huff and puff, the injection volume of carbon dioxide is 150000 $m^3$, the injection volume of nitrogen is 150000 $m^3$, and the injection volume of the water slug is 20 $m^3$. After nitrogen injection, a pressure gauge is installed at a wellhead to start soaking which lasts for 5 days, and then rapid blowout is conducted to fully use the expansion energy of crude oil, so that the crude oil after viscosity reduction can be quickly separated from the deep part of the reservoir. After blowout, pumping conversion is conducted, and when the set limit output is reached, the next cycle of composite nitrogen huff and puff is conducted.

Phase 7: in the injection phase of composite nitrogen huff and puff, in order to strengthen the residence and storage capacity of carbon dioxide and nitrogen, a foaming agent solution is injected. The injection volume of carbon dioxide is 200000 $m^3$, the injection volume of nitrogen is 100000 $m^3$, the injection volume of 0.5% HY-2 (the foaming agent solution) is 20 $m^3$, and the injection volume of the water slug is 10 m3. After nitrogen injection, a pressure gauge is installed at a wellhead to start soaking which lasts for 5 days, and then rapid blowout is conducted to fully use the expansion energy of crude oil, so that the crude oil after viscosity reduction can be quickly separated from the deep part of the reservoir.

What is claimed is:

1. A composite nitrogen huff and puff method for a bounded fault block reservoir, characterized in that the method comprises:

selecting the reservoir to be developed, wherein the reservoir to which the development method is applicable is roughly screened according to the following conditions: the reservoir is a bounded fault block reservoir, buried depth<5000 m, residual oil saturation>0.5, reservoir thickness>10 m, horizontal permeability>100 mD, vertical permeability to horizontal permeability ratio>0.35, reservoir porosity>0.20, and stratigraphic dip>8°; and sequentially performing the following huff and puff phases: a nitrogen huff and puff phase, a nitrogen and water composite huff and puff phase, a nitrogen and foaming agent composite huff and puff phase, and a nitrogen and carbon dioxide composite huff and puff phase.

2. The composite nitrogen huff and puff method for the bounded fault block reservoir according to claim 1, characterized in that the nitrogen huff and puff phase comprises the following steps: drilling a horizontal well or a vertical well in the bounded fault block reservoir; injecting nitrogen into the well, wherein the nitrogen injection amount is 50000-300000 $m^3$; after nitrogen is injected, closing the well for soaking, wherein soaking time is 10-30 days; and after soaking, opening the well for production, wherein production is finished when the oil production speed is lower than 0.1-0.5 tons/day; and the nitrogen huff and puff phase is repeated till: when the oil production (ton) and nitrogen injection ($10^4$ $m^3$) in a certain cycle are less than 5, that is, when the oil production by injecting $10^4$ $m^3$ nitrogen in this cycle is less than 5 tons, the nitrogen and water composite huff and puff phase is adopted in the next cycle.

3. The composite nitrogen huff and puff method for the bounded fault block reservoir according to claim 1, characterized in that the nitrogen and water composite huff and puff phase comprises an injection phase, a soaking phase and a stoping phase;

the injection method in the injection phase is as follows:

for medium and high permeability reservoirs with permeability greater than or equal to 100 mD, nitrogen is injected first with an injection amount of 50000-300000 $m^3$; and then water is injected with an injection volume of 100-500 $m^3$; and for low permeability reservoirs with permeability less than 100 mD, a nitrogen slug and a water slug are injected alternately, and the nitrogen slug is injected first with the injection amount depending on the pressure limitation of the nitrogen injection equipment; when the nitrogen injection pressure reaches the upper limit of the injection pressure of the nitrogen injection equipment, nitrogen injection is stopped and water slug injection is started, and the injection volume of the water slug is 30-50 $m^3$; after injecting the water slug, the nitrogen slug is injected again till the nitrogen injection pressure reaches the upper limit of the injection pressure of the nitrogen injection equipment, and then the water slug is injected again; and the nitrogen slug and the water slug are injected alternately till the total nitrogen injection reaches 50000-300000 $m^3$;

after injection, soaking production starts and lasts for 5-10 days; and after soaking, stoping starts, and crude oil is replaced till: when the oil production (ton) and nitrogen injection ($10^4$ $m^3$) in a certain cycle are less than 5, that is, when the oil production by injecting $10^4$ $m^3$ nitrogen in this cycle is less than 5 tons, the nitrogen and foaming agent composite huff and puff phase is adopted in the next cycle.

4. The composite nitrogen huff and puff method for the bounded fault block reservoir according to claim 1, characterized in that the nitrogen and foaming agent composite huff and puff phase comprises an injection phase, a soaking phase and a stoping phase;

for medium and high permeability reservoirs with permeability greater than or equal to 100 mD, nitrogen is injected first with an injection amount of 50000-300000 $m^3$; and then a foaming agent solution is injected with an injection volume of 100-500 $m^3$, the foaming agent is anion surfactant, and the concentration of the foaming agent is 0.3-0.5 wt %; and for low permeability reservoirs with permeability less than 100 mD, a nitrogen slug and a foaming agent solution slug are alternately injected, and the nitrogen slug is injected first with the injection amount depending on the pressure limitation of the nitrogen injection equipment; when the nitrogen injection pressure reaches the upper limit of the injection pressure of the nitrogen injection equipment, nitrogen injection is stopped and foaming agent solution slug injection is started, and the injection volume of the foaming agent solution slug is 30-50 $m^3$; after injecting the foaming agent solution slug, the nitrogen slug is injected again till the nitrogen injection pressure reaches the upper limit of the injection pressure of the nitrogen injection equipment, and then the foaming agent solution slug is injected again; and the nitrogen slug and the foaming agent solution slug are injected alternately till the total nitrogen injection reaches 50000-300000 $m^3$;

after injection, soaking production starts and lasts for 5-10 days; and after soaking, stoping starts till: when the oil production (ton) and nitrogen injection ($10^4$ $m^3$) in a certain cycle are less than 5, that is, when the oil production by injecting $10^4$ $m^3$ nitrogen in this cycle is less than 5 tons, the nitrogen and carbon dioxide composite huff and puff phase is adopted in the next cycle.

5. The composite nitrogen huff and puff method for the bounded fault block reservoir according to claim 1, characterized in that the nitrogen and carbon dioxide composite huff and puff phase comprises an injection phase, a soaking phase and a stoping phase;

carbon dioxide is injected first with an injection amount of 10-50 tons, and then nitrogen is injected with an injection volume of 50000-300000 $m^3$;

after injection, soaking starts and lasts for 30-90 days; and after soaking, stopping starts.

* * * * *